US010923846B1

(12) United States Patent
Raybold et al.

(10) Patent No.: US 10,923,846 B1
(45) Date of Patent: Feb. 16, 2021

(54) MODULAR HIGH PERFORMANCE CONTACT ELEMENT

(71) Applicant: TE Connectivity Services GmbH, Schaffhausen (CH)

(72) Inventors: Christopher Ryan Raybold, Elizabethtown, PA (US); John Mark Myer, Millersville, PA (US)

(73) Assignee: TE CONNNECTIVITY SERVICES GmBH

( * ) Notice: Subject to any disclaimer, the term of this patent is extended or adjusted under 35 U.S.C. 154(b) by 0 days.

(21) Appl. No.: 16/654,398

(22) Filed: Oct. 16, 2019

(51) Int. Cl.
*H01R 13/187* (2006.01)

(52) U.S. Cl.
CPC ..... *H01R 13/187* (2013.01)

(58) Field of Classification Search
CPC ..... H01R 13/187
See application file for complete search history.

(56) References Cited

U.S. PATENT DOCUMENTS

| | | | | |
|---|---|---|---|---|
| 4,720,157 | A * | 1/1988 | Nestor | H01R 13/187 439/843 |
| 4,734,063 | A | 3/1988 | Koch | |
| 8,029,326 | B2 * | 10/2011 | Rossman | H01R 13/187 439/843 |
| 2014/0357137 | A1 * | 12/2014 | Sian | H01R 13/187 439/843 |

* cited by examiner

*Primary Examiner* — Ross N Gushi

(57) ABSTRACT

A contact assembly for providing high current capabilities between an electrical terminal and a mating terminal. The contact assembly includes a conductive housing and a spring contact element. The spring contact element has first resilient contact arms, second resilient contact arms, and third resilient contact arms. The first resilient contact arms are positioned proximate the inner wall. The second resilient contact arms have second resilient contact portion bent portions which extend over the first end of the housing from the inner wall to the outer wall to retain the spring contact element in position on the housing. The third resilient contact portions have third resilient contact portion bent portions which extend over the second end of the housing from the inner wall to the outer wall to retain the spring contact element in position on the housing.

17 Claims, 7 Drawing Sheets

MODULAR HIGH PERFORMANCE CONTACT ELEMENT

FIELD OF THE INVENTION

The present invention is directed to a modular contact insert assembly with a spring contact element which provides high current capabilities with reduced resistance while allowing for flexibility in design to accommodate different current requirements.

BACKGROUND OF THE INVENTION

Electrical connectors for military, aviation, vehicular and other applications which require power must be able to withstand the environmental conditions, such as high vibrations, to which such connectors are subjected. The connectors also must provide high quality electrical connection through very broad ranges of temperature variations and harsh conditions. In many instances these electrical connectors must also accommodate extremely high amperage.

Examples of such electrical connectors which are found in the prior art may include a threaded stud terminal to which a threaded nut may be selectively connected. A typical prior art terminal for connection to such threaded stud terminal includes a mating end effectively defining a generally planar eyelet that is dimensioned to be slidably passed over the threaded stud terminal. The opposed end of such a terminal typically will be crimped and/or soldered to a conductor of the wire. The eyelet is maintained in a mated condition on the threaded stud terminal by the nut which is threaded tightly against the planar portion of the eyelet for securely retaining the terminal on the threaded stud terminal and for providing the high contact forces that are desired.

Such typical prior art electrical connector performs well under routine environmental conditions. However, the threaded components of these prior art connectors are fairly expensive to manufacture. Furthermore, the threaded interconnection adds significantly to assembly time and costs and can make disassembly for periodic repair and maintenance difficult, particularly as torque wrenches are required to properly seat the hardware. A number of parts are required to perfect the electrical connection, thereby also adding to the cost of the connection and creating the possibility of foreign object debris (FOD) which could damage engines and the like. Also, as the connectors are exposed to vibration and the like, the nuts may rotate off of the threaded component, which can lead to a failed, open electrical connection. In addition, any attempt to provide environmental sealing for such an electrical connection will generally require an entirely separate protection means that is functionally and structurally unrelated to the threaded interconnection to the alternator.

Various prior art electrical connectors rely upon resiliency of the metal to achieve electrical connection. However, it is extremely difficult to achieve the high contact forces with an electrical connector that must also ensure a large surface contact area and a large cross sectional area of metal to affect a reliable electrical connection.

Other examples of prior art electrical connectors have included springs means which are intended to achieve secure electrical connection without resorting to combinations of threads and nuts. It has proven to be disadvantageous with these known contact spring sockets that one must have a relatively large sleeve to mount the contact springs and hold them in place, particularly in the case where one attempts miniaturization of contact spring sockets. In addition, the manufacture of such springs contacts can prove difficult, particularly in application in which the space is limited, as the punch tooling required to manufacture the springs may have sufficient clearance, thereby limiting the closeness of the spacing of the spring arms of the spring contacts.

It would, therefore, be beneficial to provide a modular contact assembly with a spring contact element which has closely spaced contact arms to provide for more contact points to accommodate high current carrying capacity while requiring low insertion forces. In addition, it would be beneficial to provide a modular contact insert with a spring contact element which has multiple contact points provided in line with each other to facilitate a cleaning action to allow for a positive electrical connection in harsh environment.

SUMMARY OF THE INVENTION

In view of the above, it is an object to provide a contact element which is compact and modular, thereby allowing a number of contact elements to be used.

It is another object to provide contact elements which have reduced insertion force and have high current capabilities.

It is another object to have a high amperage contact element which can be used over many cycles and which enables quick connection and disconnection.

It is another object to provide a system in which increased contact points are provided between a contact element a mating connector or post.

It is another object to provide a gas tight interface between a contact element and the contact body.

An embodiment is directed to a contact assembly for providing high current capabilities between an electrical terminal and a mating terminal. The contact assembly includes a conductive housing and a spring contact element. The conductive housing has a first end, a second end, an inner wall and an outer wall. The spring contact element has first resilient contact arms, second resilient contact arms, and third resilient contact arms. The first resilient contact arms are positioned proximate the inner wall and have mating contact engagement portions for engaging the mating terminal and first housing engagement portions for engaging the inner wall of the housing. The second resilient contact arms have second resilient contact portion bent portions which extend over the first end of the housing from the inner wall to the outer wall. The second resilient contact arms have first terminal engagement portions for engaging the electrical terminal and second housing engagement portions for engaging the outer wall of the housing. The third resilient contact portions have third resilient contact portion bent portions which extend over the second end of the housing from the inner wall to the outer wall. The third resilient contact portions have second terminal engagement portions for engaging the electrical terminal and third housing engagement portions for engaging the outer wall of the housing.

An embodiment is directed to a contact assembly for providing high current capabilities between an electrical terminal and a mating terminal. The contact assembly includes a conductive housing and a spring contact element. The conductive housing has a first end, a second end, an inner wall and an outer wall. The spring contact element has first resilient contact arms extending between a first contact strip and a second contact strip, second resilient contact arms extending from the first contact strip, third resilient contact arms extending form the second contact strip. The first resilient contact arms are positioned proximate the inner wall and have mating contact engagement portions and first housing engagement portions. The mating contact engagement portions of the first resilient contact portions electrically engage the mating terminal when the mating terminal is fully inserted into the electrical terminal. The first housing engagement portions of the first resilient contact portions electrically engage the inner wall of the conductive housing. The second resilient contact arms have first resilient contact portion bent portions which extend over the first end of the housing from the inner wall to the outer wall. Free ends of the second resilient contact arms are positioned proximate the outer wall and have first terminal engagement portions and second housing engagement portions. The first terminal engagement portions of the second resilient contact arms electrically engage the electrical terminal. The second housing engagement portions of the second resilient contact arms electrically engage the outer wall of the conductive housing. The third resilient contact arms have second resilient contact portion bent portions which extend over the second end of the housing from the inner wall to the outer wall. Free ends of the third resilient contact arms are positioned proximate the outer wall and have second terminal engagement portions and third housing engagement portions. The second terminal engagement portions of the third resilient contact arms electrically engage the electrical terminal. The third housing engagement portions of the third resilient contact arms electrically engage the outer wall of the conductive housing.

Other features and advantages of the present invention will be apparent from the following more detailed description of the illustrative embodiment, taken in conjunction with the accompanying drawings which illustrate, by way of example, the principles of the invention.

DETAILED DESCRIPTION OF THE INVENTION

Figure 1:
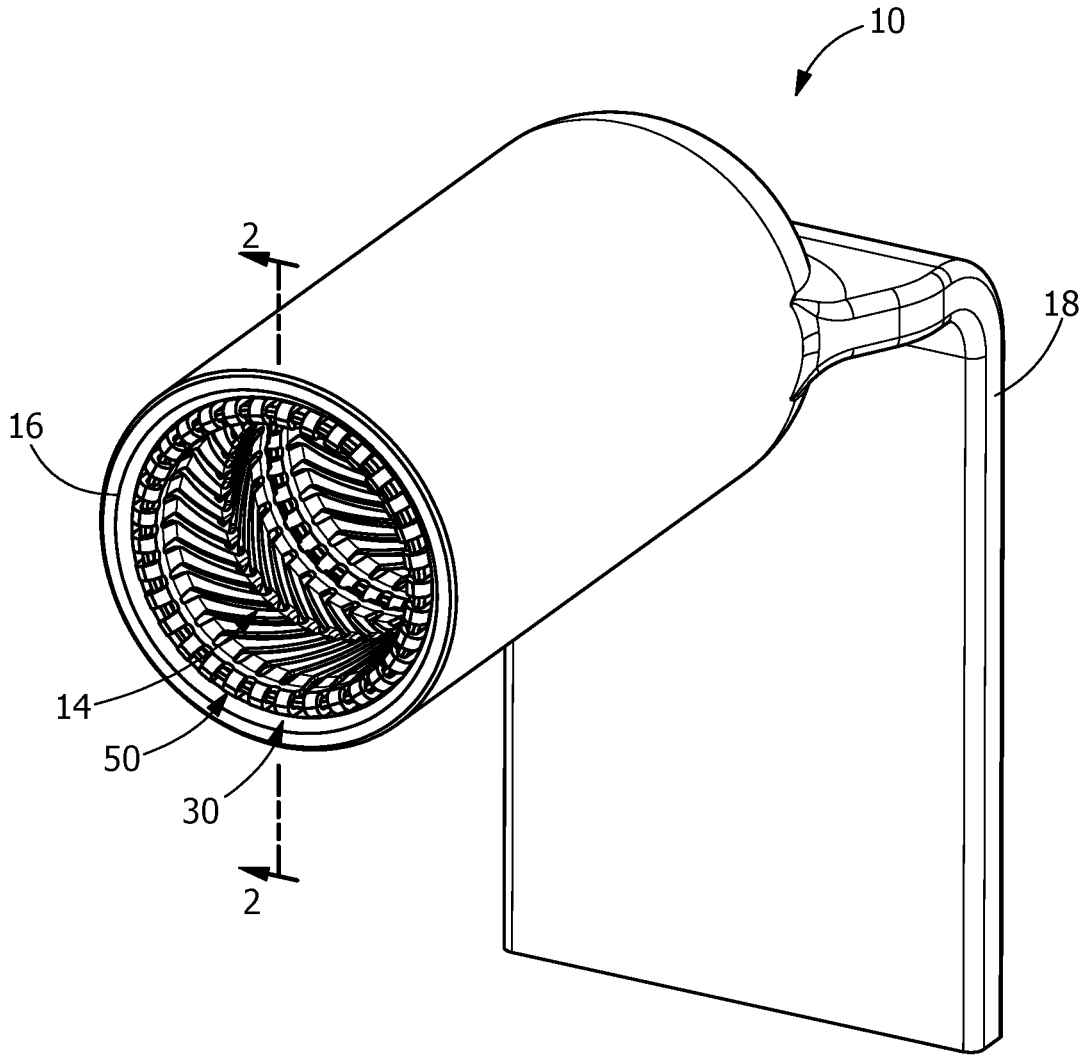
FIG. 1 is a perspective view of an illustrative electrical terminal with two modular contact assemblies inserted into a receiving cavity of the terminal.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Moreover, the features and benefits of the invention are illustrated by reference to the preferred embodiments. Accordingly, the invention expressly should not be limited to such embodiments illustrating some possible non-limiting combination of features that may exist alone or in other combinations of features, the scope of the invention being defined by the claims appended hereto.

The present invention is directed to a modular contact assembly 30 with a spring contact element 50 which provides a quick and simple connection to a mating contact. In particular, the invention is directed to a modular contact assembly and a spring contact element which provides high current capabilities while providing a reliable connection to the mating contact. While the modular contact assembly 30 is shown positioned in an exemplary electrical terminal 10, the modular contact assembly 30 may be used with many different types of contacts or contact assemblies. The use of the modular contact assembly 30 is, therefore, not limited to use with the illustrative electrical terminal 10 and/or the mating contact disclosed herein.

FIG. 1 illustrates a perspective view of an illustrative electrical contact or receptacle 10 into which one or more modular contact assemblies 30 may be inserted. The terminal 10 is shown prior to mating with a mating contact (not shown), such as, but not limited to, a post or mating pin. The electrical terminal 10 is shown as an illustrative representation, as the particular configuration of the terminal 10 and mating contact may vary without departing from the scope of the invention. Therefore, the use and applicability of the modular contact assembly 30 is not limited to the illustrative terminal 10 shown.

Figure 2:
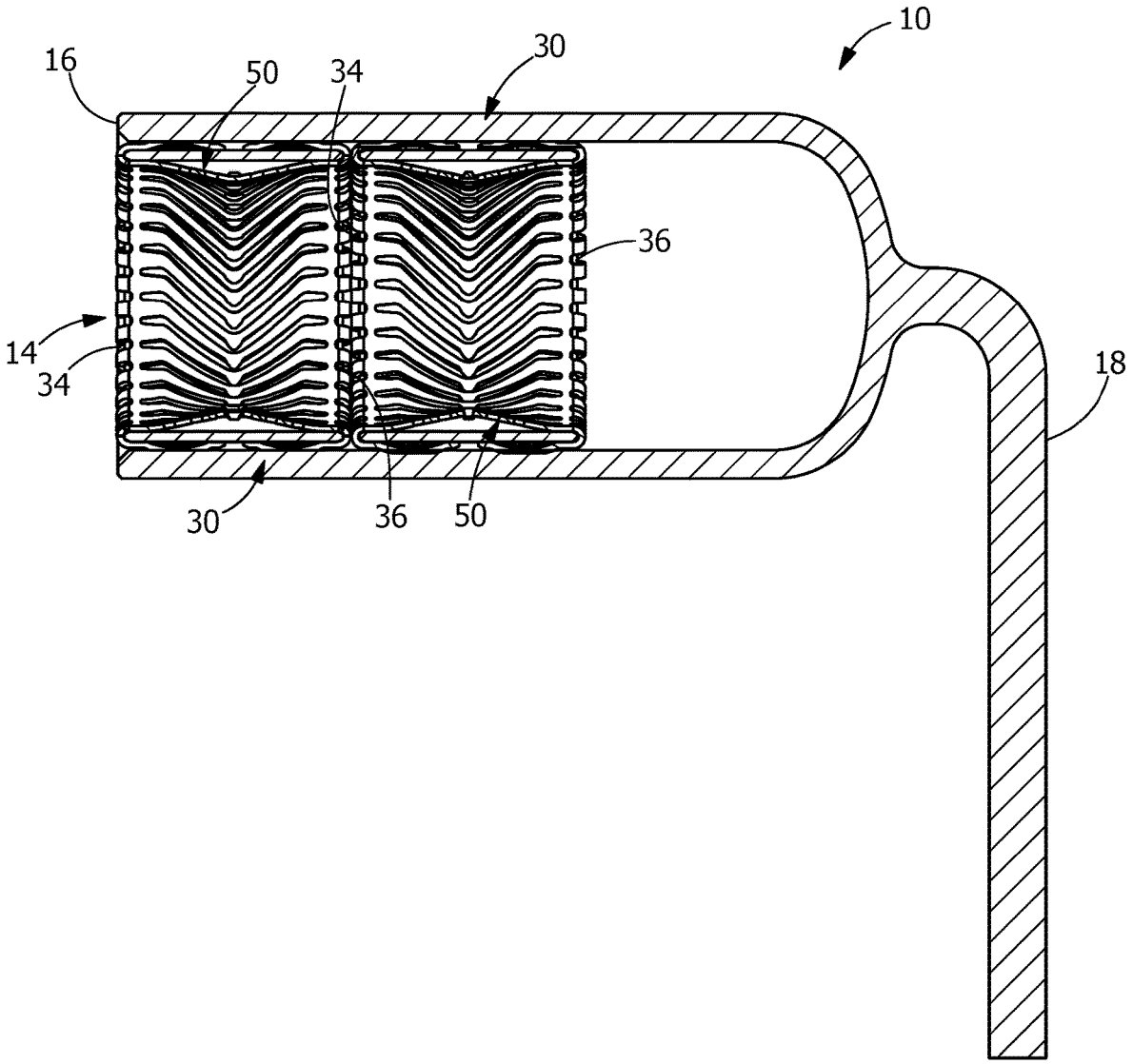
FIG. 2 is a cross-sectional view taken along line 2-2 of FIG. 1.

As shown in FIGS. 1 and 2, the illustrative electrical terminal 10 has a post receiving passage 14 for receiving the respective mating contact therein. In the embodiment shown, the electrical terminal 10 is a high amperage power contact that is capable of carrying, for example, up to about 400 amps or more, with a relatively small footprint. The electrical terminal 10 has a first end 16 which defines an opening to the post receiving passage 14 extending therefrom. In the illustrative embodiment shown, the terminal 10 has a mounting post, tab or area 18. Alternatively, wire receiving opening (not shown) or other mounting member may be provided to allow the terminal 10 to be terminated to a wire or substrate by crimping, soldering or other known termination methods. An insulation receiving recess may extend circumferentially around a portion of the terminal 10 to allow an insulator, such as, but not limited to, a boot, to be installed. Alternatively, the electrical terminal 10 may be provided in an electrical connector which includes a housing surrounding the terminal 10 to provide the required electrical insulation.

The terminal 10 is made from an electrically conductive material, such as, but not limited to, phosphor-bronze, brass, beryllium-copper alloy, stainless steel, etc. The terminal 10 may be provided in an electrical connector with a housing body, which is made from plastic or other material having nonconductive properties, thereby allowing the housing body and the terminal 10 to be engaged by the operator/user.

The modular contact assembly 30, as shown in FIGS. 3 through 7 has cylindrical member or housing 32 with a spring contact member or element 50 positioned therein. The cylindrical housing 32 has a first end 34 and an oppositely facing second end 36. An outwardly facing outer wall 38 extends between the first end 34 and the second end 36. An inwardly facing inner wall 40 extends between the first end 34 and the second end 36. The inner wall 40 defines a mating terminal receiving opening 42. The cylindrical member or housing 32 of the modular contact assembly 30 is made from an electrically conductive material, such as, but not limited to, phosphor-bronze, brass, beryllium-copper alloy, stainless steel, etc.

The spring contact member or element 50 cooperates with the cylindrical housing 32, as will be more fully described. The spring contact member 50 may be manufactured in a continuous strip, cut to length, and bent into the desired shape. Alternatively, the spring contact member 50 may be manufactured as individual pieces in the desired shape, such as, but not limited to, circular. The spring contact member 50 may be manufactured by different methods, including, but not limited to, stamping and forming or extrusion.

Figure 3:
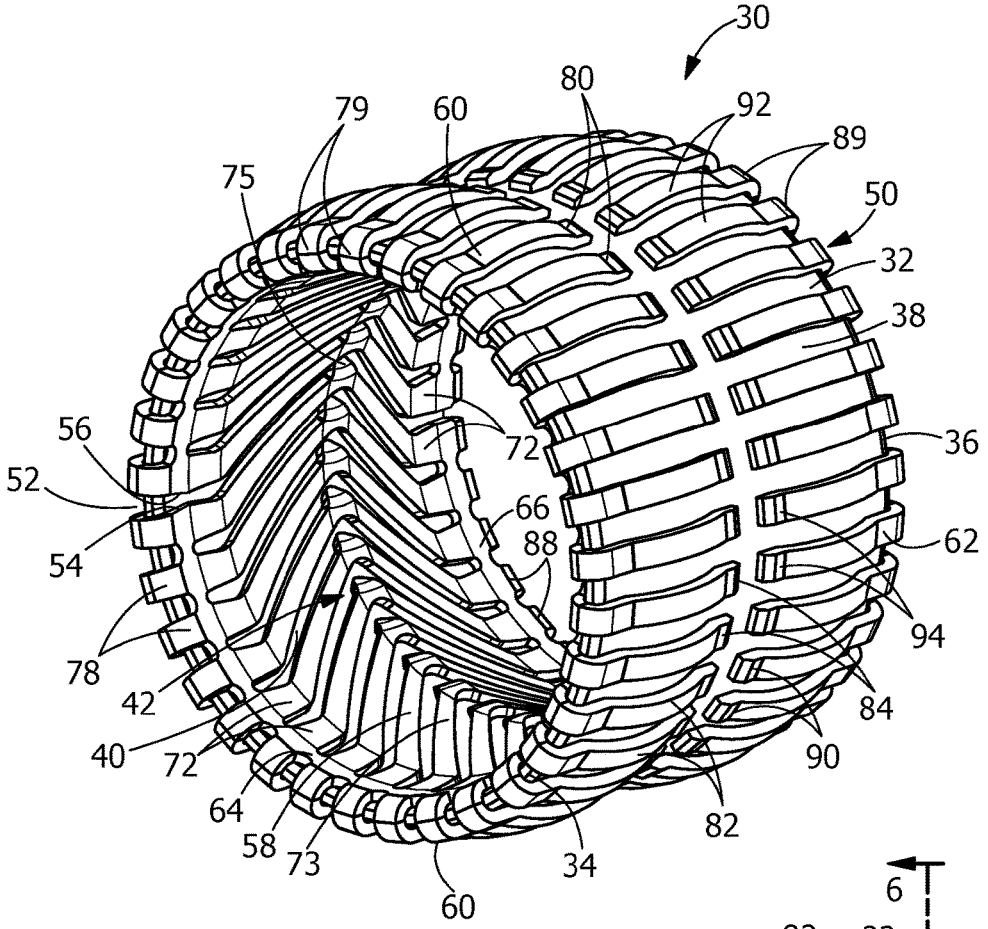
FIG. 3 is a perspective view of an illustrative modular contact assembly of the present invention.
Figure 4:
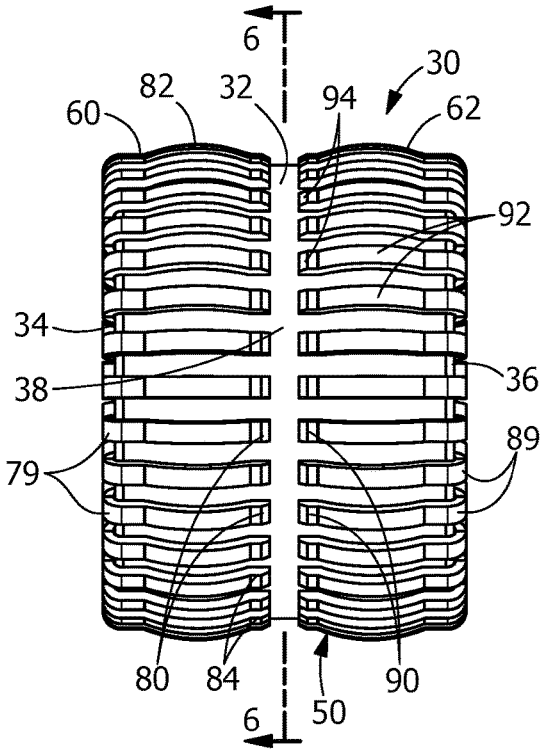
FIG. 4 is a side view of the modular contact assembly of FIG. 3.
Figure 5:
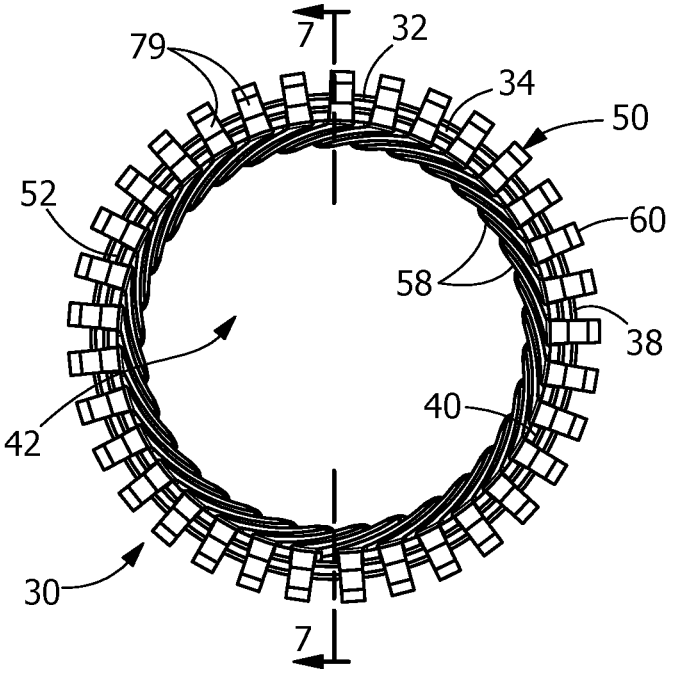
FIG. 5 is an end view of the modular contact assembly of FIG. 3.

As shown in FIG. 3, the spring contact element 50 is formed with a gap 52 provided between a first end 54 and a second end 56 of the spring contact element 50. This gap 52 allows the contact element 50 to be resiliently compressed to allow the contact element 50 to be inserted into the opening 42 of the housing 32. As the contact element 50 is moved into position in the opening 42, the contact element 50 returns toward an unstressed position, thereby causing the contact element 50 to snap or expand in the opening 42 and be resiliently retained in the opening 42 and the housing 32.

Figure 7:
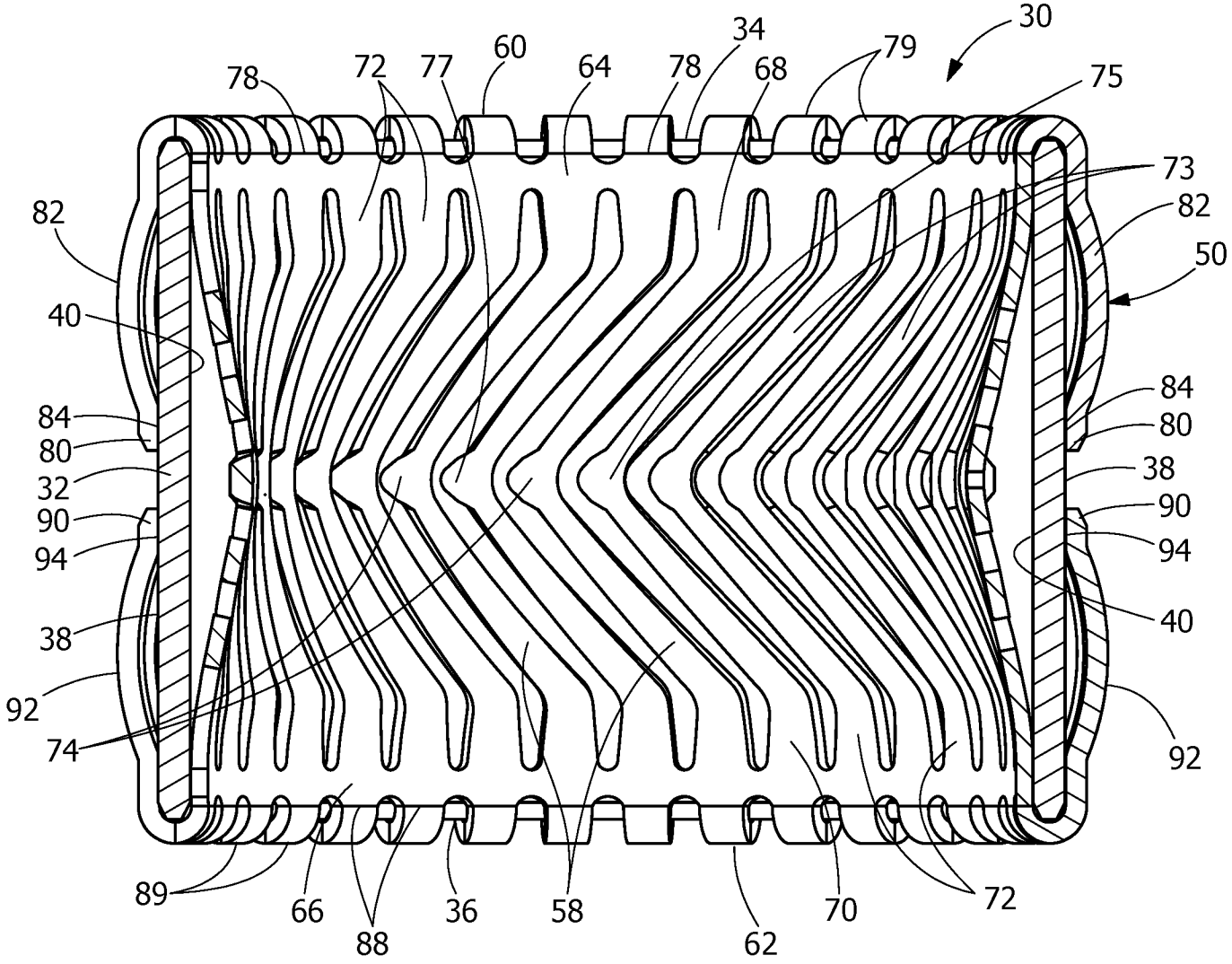
FIG. 7 is a cross-sectional view taken along line 7-7 of FIG. 5.

As shown in FIGS. 3 and 7, the illustrative contact element 50 has multiple first resilient contact arms 58, multiple second resilient contact arms 60 and multiple third resilient contact arms 62.

As shown in FIG. 7, each of the first resilient contact arms 58 extends from a first contact strip 64 to a second contact strip 66. First ends 68 of the first resilient contact arms 58 are integrally attached to the first contact strip 64. Second ends 70 of the first resilient contact arms 58 are integrally attached to the second contact strip 66. The first resilient contact arms 58 are formed to have a V-shaped configuration (as viewed in FIGS. 3 and 7) with housing engagement portions 72 positioned proximate the first ends 68 and the second ends 70. Spring beams 73 extend between the housing engagement portions 72. The spring beams 73 have mating contact engagement portions 74 with edge portions 77 provided thereon. In the illustrative embodiment shown, the mating contact engagement portion 74 of each spring beam 73 of each first resilient contact arm 58 is positioned approximately equidistant from the respective housing engagement portions 72. Each of the housing engagement portions 72 have an arch or dogleg configuration. The arch configuration allows the housing engagement portions 72 to act as a torsional spring in this area, ensuring that the housing engagement portions 72 are provided in mechanical and electrical engagement with inner wall 40 of the housing 32 of the modular contact assembly 30. The spring beams 73 behave like a standard cantilever beam. The mating contact engagement portions 74 of the first resilient contact arms 58 may engage the inner wall 40 of the housing 32 when the mating contact in inserted into mating terminal receiving opening 42 to protect the spring beams 73 from overstress. The combination of the torsional springs at the housing engagement portions 72 and the standard cantilever beams at the spring beams 73 allow the first resilient contact arms 58 to be used with both ends fixed and exhibit a repeatable normal force.

Figure 6:
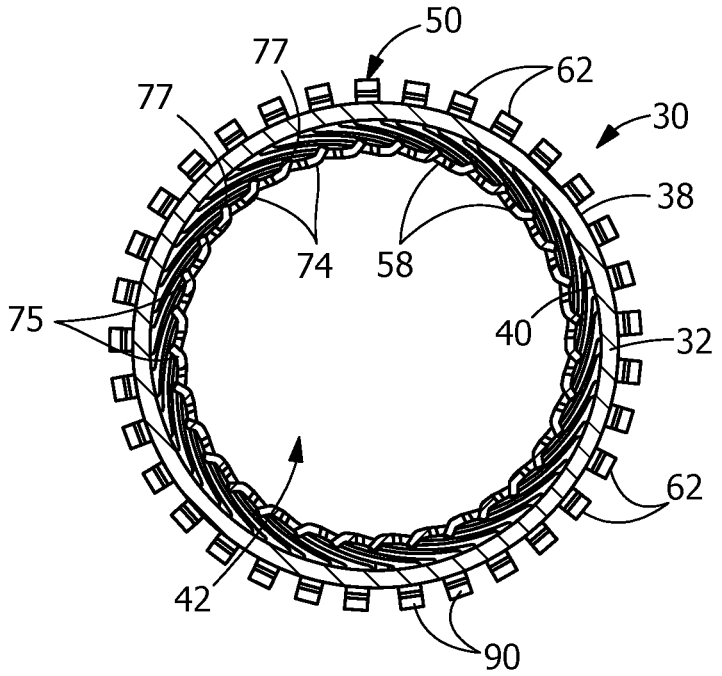
FIG. 6 is a cross-sectional view taken along line 6-6 of FIG. 4.

The mating contact engagement portions 74, as shown in FIG. 6, have a twist or flare portion 75. As a result of the torsional forces produced by the mating contact engagement portions 74, edge portions 77 of the mating contact engagement portions 74 are positioned closer to the inner wall 40 of the housing 32. As the mating pin is inserted into the mating terminal receiving opening 42 of the housing 32, the edge portions 77 may engage the inner wall 40 to prevent overstress to the spring beams 73 and support the spring beams 73 when the spring beams 73 are deflected past their intended range of operation.

Each of the second resilient contact arms 60 extends from the first contact strip 64. First ends 78 of the second resilient contact arms 60 are integrally attached to the first contact strip 64. The second resilient contact arms 60 are formed such that the second resilient contact arms 60 have bend portions 79 proximate the first ends 78, thereby positioning second or free ends 80 of the second resilient contact arms 60 proximate the outer wall 38 of the housing 32 of the modular contact assembly 30. The second resilient contact arms 60 are formed to have an undulating configuration with terminal engagement portions 82 positioned between the bend portions 79 and the free ends 80. Housing contact engagement portions 84 are provided on the second resilient contact arms 60 at the free ends 80. The housing contact engagement portions 84 of the second resilient contact arms 60 are formed to cooperate with the housing engagement portions 72 of the first resilient contact arms 68 to frictionally engage or capture the first end 34 of the housing 32 of the modular contact assembly 30 therebetween to retain the spring contact element 50 on the housing 32. This allows the second resilient contact arms 60 to act as compliant sections to provide additional forces to maintain a permanent interface between the terminal engagement portions 82 and the terminal 10 in all conditions, such as, but not limited to, thermal cycling.

Each of the third resilient contact arms 62 extends from the second contact strip 66. First ends 88 of the third resilient contact arms 62 are integrally attached to the second contact strip 66. The third resilient contact arms 62 are formed such that the third resilient contact arms 62 have bend portions 89 proximate the first ends 88, thereby positioning second or free ends 90 of the third resilient contact arms 62 proximate the outer wall 38 of the housing 32 of the modular contact assembly 30. The third resilient contact arms 62 are formed to have an undulating configuration with terminal engagement portions 92 positioned between the bend portions 89 and the free ends 90. Housing contact engagement portions 94 are provided on the third resilient contact arms 62 at the free ends 90. The housing contact engagement portions 94 of the third resilient contact arms 62 are formed to cooperate with the housing engagement portions 72 of the first resilient contact arms 68 to frictionally engage or capture the second end 36 of the housing 32 of the modular contact assembly 30 therebetween to retain the spring contact element on the housing 32. This allows the third resilient contact arms 62 to act as compliant sections to provide additional forces to maintain a permanent interface between the terminal engagement portions 92 and the terminal 10 in all conditions, such as, but not limited to, thermal cycling.

The spring contact elements 50 are manufactured (i.e. stamped and formed) from an electrically conductive material, such as, but not limited to, phosphor-bronze, brass, beryllium-copper alloy, stainless steel, etc. In order to enhance the electrical conductivity of the contact elements 50, the elements 50 may be plated using known techniques and materials, such techniques may include, but are not limited to immersing the contact elements 50 in a plating bath or selectively plating only the contact sections of the contact elements 50. In the embodiment shown, respective first resilient contact arms 58, respective second resilient contact arms 60 and respective resilient contact arms 62 are positioned in line with each other. However, other embodiments may be used without departing from the scope of the invention.

The configuration of modular contact assembly 30 and the contact element 50 provides multiple electrical contact points or areas between the terminal 10 and the mating terminal. The increased contact area provides high current capabilities allowing improved electrical conductivity. Improved electrical conductivity is exemplified by lower operating temperatures of the contact element, and lower resistive loss between connections resulting in lower voltage drop and lower power consumption. The configuration of the contact element 50 is proportioned so that the rated current and voltage can be safely transmitted across the contact element 50.

During assembly of the modular contact assembly 30, the stamped cylindrical contact element 50 is compressed and inserted into the mating terminal receiving opening 42 of the housing 32. In this initial step, the second resilient contact arms 60 and the third resilient contact arms 62 are not bent, thereby allowing for the insertion of the contact element 50 into the mating terminal receiving opening 42. With the contact element 50 properly position, the contact element is allowed to return toward its unstressed position, thereby causing the contact element 50 to snap or expand in the mating terminal receiving opening 42 and be resiliently retained in the mating terminal receiving opening 42.

With the contact element 50 resiliently retained in the mating terminal receiving opening 42, the second resilient contact arms 60 are bent to the position shown FIGS. 1 through 8. The third contact arms 62 are also bent to the position shown FIGS. 1 through 8. The second resilient contact arms 60 and the third resilient contact arms 62 may be bent at the same time or during independent steps. The contact arms 60, 62 may be bent using various methods, including, but not limited to, using a conical tool to initially bend the contact arms 60, 62 and then a flat tool to end the contact arms 60, 62 to the position shown FIGS. 1 through 8.

With the second resilient contact arms 60 and the third resilient contact arms 62 bent, the second resilient contact arms 60, including the bend portions 79 of the second resilient contact arms 60, cooperate with the first end 34 of the housing 32 and the third resilient contact arms 62, including the bend portions 89 of the third resilient contact arms 62, cooperate with the second end 36 of the housing 32 to limit or prevent the movement of the contact element 50 in direction which is parallel to the longitudinal axis of the housing 32.

With the contact element 50 properly positioned in the mating terminal receiving opening 42 and the modular contact assembly 30 properly positioned in the post receiving passage 14 of the terminal 10, a mating contact (not shown) is inserted into the mating terminal receiving opening 42. As insertion occurs, the spring beams 73 of the first contact arms 58 are resiliently deformed by the mating contact toward the inner wall 40 of the housing 32 of the modular contact assembly 30. As this occurs, the insertion of the mating contact and the shape of the first resilient contact arms 58 causes torsional rotation of the housing engagement portions 72 of the first resilient contact arms 58 toward the inner wall 40 causing the housing engagement portions 72 to exert a force on the inner wall 40. This causes the housing engagement portions 72 to be placed in physical and electrical engagement with the inner wall 40. In addition, as the mating contact engagement portions 74 of the first resilient contact arms 58 extend into the mating terminal receiving opening 42, the mating contact engagement portions 74 of the first resilient contact arms 58 exert force on the mating contact as insertion of the mating contact into the mating terminal receiving opening 42 continues, thereby placing the mating contact engagement portions 74 in physical and electrical engagement with the mating contact. The combination of numerous contact sections and the resilient forces exerted thereon, result in a stable electrical connection which can safely and effectively transmit high current there across.

When the modular contact assembly 50 is positioned in the post receiving passage 14 of the terminal 10, the housing engagement portions 84 of the second contact arms 60 and the housing engagement portion 94 of the third contact arms 62 are positioned in electrical and mechanical engagement with the outer wall 38. In addition, the terminal engagement portions 82 of the second contact arms 60 and the terminal engagement portions 92 of the third contact arms 62 are positioned in electrical and mechanical engagement with the outer wall 38 of the post receiving passage 14 of the terminal 10. As shown for example in FIG. 7, the terminal engagement portion 82 has an undulation or arch projected outwardly to contact an inner wall of the modular contact assembly 30.

The use of multiple contact sections 72, 74, 82, 84, 92, 94 on multiple contact arms 58, 60, 62 allows the contact elements 50 and the one or more modular contact assemblies 30 to carry high amperage required by the electrical power contacts without increasing the length or diameter of the passage 14. Significantly more contact surfaces are placed in a given length (i.e., higher density of contact surfaces) thereby allowing an increased performance in power transfer across the contact elements 50. The redundant contact sections provide for passage of high amperage current with millivolt drop (for example, but not limited to, 5-25 MVD) and lower temperature rise at high current (for example, but not limited to, 10-75 degrees Celsius with current limits to 1000 amp), thereby increasing the performance of the contact elements 50 by greater than 50%, greater than 60%, greater than 70%, between about 50% and about 70%, between about 50% and about 60%, or any suitable combination, sub-combination, range, or sub-range therein, over known contacts.

In the illustrative embodiment shown in FIG. 2, the terminal 10 has two modular contact assemblies 30 positioned in the post receiving passage 14. The use of In the embodiment shown, respective contact elements 50 are positioned in each of the receiving recesses 30. The use of multiple contact elements 50 provides greater contact sections 72, 74, 82, 84, 92, 94 which increase the contact area between the contact elements 50 and the mating terminal and the contact elements 50 and the terminal 10. The increased contact area provides high current capabilities allowing improved electrical conductivity. Improved electrical conductivity is exemplified by lower operating temperatures of the contact elements, and lower resistive loss between connections resulting in lower voltage drop and lower power consumption. The number of modular contact assemblies 30 and contact elements 50 is proportioned so that the rated current and voltage can be safely transmitted across the contact elements 50.

The multiple contact areas allows for the steady state current load and the transient (short term) current allowance to be increased. Additionally, due to the increase in the number of contact and mating contact engagement portion or points, a lower normal force is needed to properly mate the mating terminal to the terminal 10, resulting the terminal 10 and contact element 50 having a high mating cycle allowance.

Figure 8:
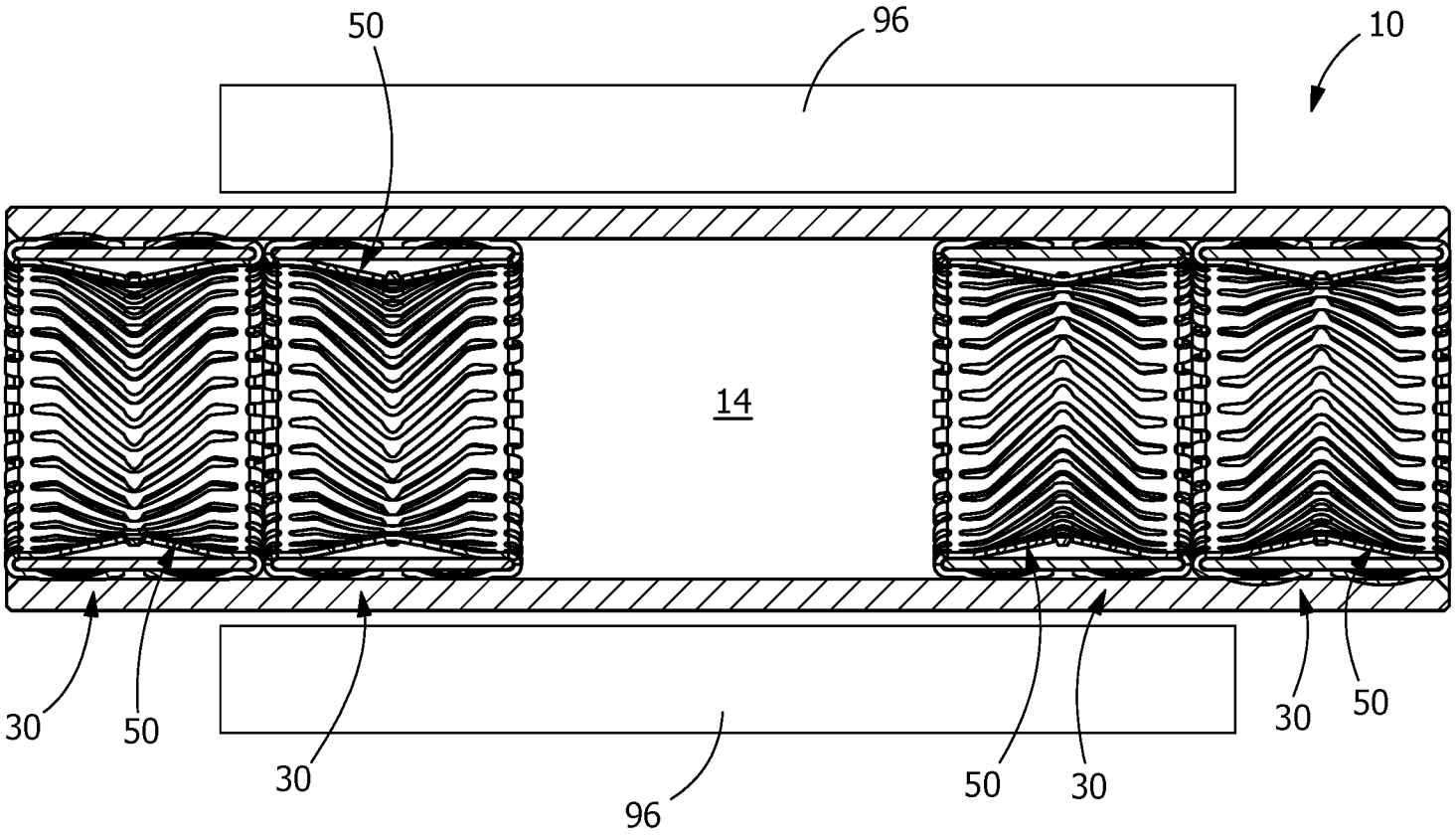
FIG. 8 is an embodiment of an alternate terminal with modular contact assemblies inserted into respective receiving cavities of the terminal.

In the illustrative embodiment shown in FIG. 8, an alternate embodiment of the terminal 10 is shown. In this embodiment, the mating terminal receiving passage 14 extends through the entire length of the terminal 10, allowing a mating terminal to be inserted from either side. Two modular connector assemblies 30 are provided at either end of the mating terminal receiving passage 14. Cooling devices 96 are provided on either side of the terminal 10 to help remove the heat from the terminal 10.

In general, the configuration of the terminal 10 and the contact elements 50 allow for the contact to be mated with a mating contact from any direction. In various circumstances, for example, because of lack of space or the inflexibility of the wire, it is difficult to manipulate and twist the wire connected to the contact element 50. It is, therefore, important that the terminal 10 be able to be terminated to the post regardless of the orientation of the wire relative to the post without damage to the wire or the post.

Figure 9:
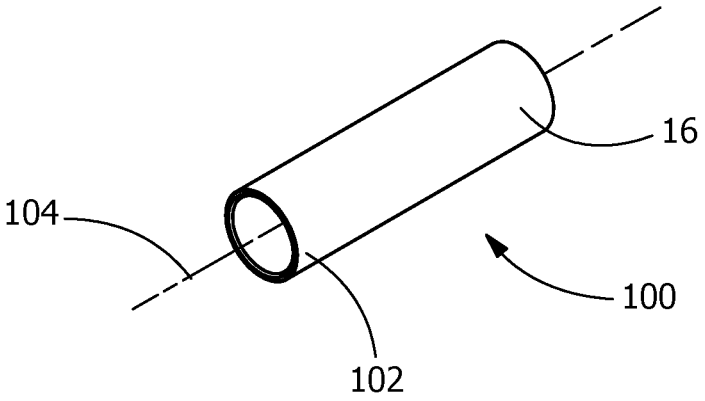
FIG. 9 is a perspective view a tube body of the terminal prior to being formed.

In the illustrative embodiment shown, the terminals 10 are manufactured from a copper tube body 100 which is formed into the desired configuration. As shown in FIG. 9, the copper tube body 100 is initially provided in a cylindrical configuration. In the configuration shown in FIG. 9, the tube body 100 is plated to plate the open first or mating end 16 with corrosion protection. The opposed mounting end 102 is left unplated, which allows for the opposed mounting end 102 to be ultrasonically welded or the like.

Figure 10:
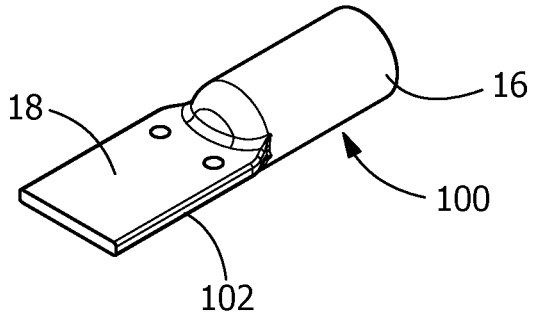
FIG. 10 is a perspective view the tube body of the terminal of FIG. 9 with an end flattened to form a weld tab.

With the mating end 16 plated, the opposed mounting end 102 is flattened, as shown in FIG. 10 to provide a weld tab 18. By plating the tube body 100 before the opposed mounting end 102 is flattened, the need for a weep hole is eliminated, as the plating salts used in plating can escape through the open, unflattened opposed mounting end 102 before it is formed.

Figure 11:
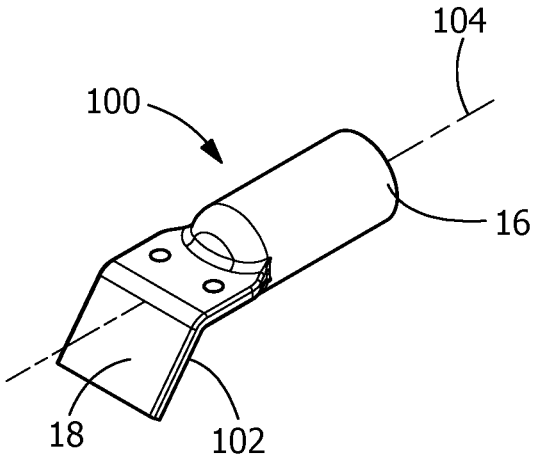
FIG. 11 is a perspective view the tube body of the terminal of FIG. 10 with the flattened end bent at 45 degrees.

Once flattened, the opposed mounting end 102 can be bent to any configuration desired, including, but not limited to 45 degrees relative to the longitudinal axis 104 of the open mating end 16 (FIG. 11) or to 90 degrees relative to the longitudinal axis 104 of the mating end 16 102 (FIGS. 1 and 2).

With the tube body 100 properly plated and formed, one or more contact assemblies are provided in the open mating end 16 for providing high current capabilities between the electrical terminal and a mating terminal, as previously described.

The terminal 10 made with the tube body 100 allows for a matte seal to be placed on the tube body 100 in different locations, and not be limited to being placed behind a weep hole as required by the known art. In addition, as no weep hole is provided, the terminal 10 of the present invention is less prone to dust and liquid intruding into the sealed terminal.

While the contact element can be used in many different housings for many different applications, the configuration allows for use with high amperage electrical connections which may require up to 1200 amps or more per contact. The contact elements, are also scalable, allowing the contacts to be sized for the desired application, such as, for example, the contact elements can be configured to operate with 4 AWG wire as well as 70 AMP contacts.

While the invention has been described with reference to a preferred embodiment, it will be understood by those skilled in the art that various changes may be made and equivalents may be substituted for elements thereof without departing from the spirit and scope of the invention as defined in the accompanying claims. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. A contact assembly for providing high current capabilities between an electrical terminal and a mating terminal, the contact assembly comprising:

a conductive housing having a first end, a second end, an inner wall and an outer wall;

a spring contact element having first resilient contact arms, second resilient contact arms, and third resilient contact arms;

the first resilient contact arms positioned proximate the inner wall, the first resilient contact arms having mating contact engagement portions for engaging the mating terminal and first housing engagement portions for engaging the inner wall of the housing, the mating contact engagement portions having a twisted portion which allows edge portions of the mating contact engagement portions to be positioned closer to the inner wall of the housing;

the second resilient contact arms having second resilient contact portion bent portions which extend over the first end of the housing from the inner wall to the outer wall, the second resilient contact arms having first terminal engagement portions for engaging the electrical terminal and second housing engagement portions for engaging the outer wall of the housing;

the third resilient contact portions having third resilient contact portion bent portions which extend over the second end of the housing from the inner wall to the outer wall, the third resilient contact portions having second terminal engagement portions for engaging the electrical terminal and third housing engagement portions for engaging the outer wall of the housing.

2. The contact assembly as recited in claim 1, wherein the first resilient contact arms have a V-shaped configuration with the first housing engagement portions positioned proximate ends of the first resilient contact arms.

3. The contact assembly as recited in claim 2, wherein the first resilient contact arms have spring beams which extend between the first housing engagement portions.

4. The contact assembly as recited in claim 3, wherein the spring beams have the mating contact engagement portions provided thereon, the mating contact engagement portions of each of the spring beams are positioned approximately equidistant from the first housing engagement portions of each of the spring beams.

5. The contact assembly as recited in claim 4, wherein the first housing engagement portions have an arch configuration to allow the first housing engagement portions to act as a torsional spring.

6. The contact assembly as recited in claim 5, wherein the spring beams are cantilever beams, wherein the combination of the torsional springs at the first housing engagement portions and the cantilever beams at the spring beams allow the first resilient contact arms to be used with both ends fixed and exhibit a repeatable normal force.

7. The contact assembly as recited in claim 1, wherein the first terminal engagement portions of the second resilient contact arms are positioned between the bend portions and the free ends of the second resilient contact arms.

8. The contact assembly as recited in claim 7, wherein the second housing contact engagement portions of the second resilient contact arms are provided proximate the free ends of the second resilient contact arms.

9. The contact assembly as recited in claim 8, wherein the second terminal engagement portions of the third resilient contact arms are positioned between the bend portions and the free ends of the third resilient contact arms.

10. The contact assembly as recited in claim 9, wherein the third housing contact engagement portions of the third resilient contact arms are provided proximate the free ends of the third resilient contact arms.

11. The contact assembly as recited in claim 1, wherein the second housing contact engagement portions of the second resilient contact arms and the first housing contact engagement portions of the first resilient contact arms engage the first end of the housing to retain the spring contact element in position on the housing.

12. The contact assembly as recited in claim 11, wherein the third housing contact engagement portions of the third resilient contact arms and the first housing contact engagement portions of the first resilient contact arms engage the second end of the housing to retain the spring contact element in position on the housing.

13. The contact assembly as recited in claim 1, wherein the spring contact element has a generally cylindrical shape, with a gap provided therein, the gap allowing the spring contact element to be resiliently compressed.

14. A contact assembly for providing high current capabilities between an electrical terminal and a mating terminal, the contact assembly comprising:

a conductive housing having a first end, a second end, an inner wall and an outer wall;

a spring contact element having first resilient contact arms extending between a first contact strip and a second contact strip, second resilient contact arms extending from the first contact strip, third resilient contact arms extending form the second contact strip;

the first resilient contact arms positioned proximate the inner wall, the first resilient contact arms having mating contact engagement portions and first housing engagement portions, the mating contact engagement portions of the first resilient contact portions electrically engage the mating terminal when the mating terminal is fully inserted into the electrical terminal, the first housing engagement portions of the first resilient contact portions electrically engage the inner wall of the conductive housing;

the second resilient contact arms having first resilient contact portion bent portions which extend over the first end of the housing from the inner wall to the outer wall, free ends of the second resilient contact arms positioned proximate the outer wall, the second resilient contact arms having first terminal engagement portions and second housing engagement portions, the first terminal engagement portions of the second resilient contact arms having undulations which space the first terminal engagement portions away from the outer wall of the conductive housing, the first terminal engagement portions electrically engage the electrical terminal, the second housing engagement portions of the second resilient contact arms electrically engage the outer wall of the conductive housing;

the third resilient contact arms having second resilient contact portion bent portions which extend over the second end of the housing from the inner wall to the outer wall, free ends of the third resilient contact arms positioned proximate the outer wall, the third resilient contact arms having second terminal engagement portions and third housing engagement portions, the second terminal engagement portions of the third resilient contact arms having undulations which space the second terminal engagement portions away from the outer wall of the conductive housing, the second terminal engagement portions electrically engage the electrical terminal, the third housing engagement portions of the third resilient contact arms electrically engage the outer wall of the conductive housing.

15. The contact assembly as recited in claim 14, wherein the first resilient contact arms have spring beams which extend between the first housing engagement portions, the first housing engagement portions have an arch configuration to allow the first housing engagement portions to act as a torsional spring, the spring beams are cantilever beams, wherein the combination of the torsional springs at the first housing engagement portions and the cantilever beams at the spring beams allow the first resilient contact arms to be used with both ends fixed and exhibit a repeatable normal force.

16. The contact assembly as recited in claim 14, wherein the mating contact engagement portions have a twisted portion which allows edge portions of the mating contact engagement portions to be positioned closer to the inner wall of the housing.

17. The contact assembly as recited in claim 14, wherein the second housing contact engagement portions of the second resilient contact arms and the first housing contact engagement portions of the first resilient contact arms engage the first end of the housing to retain the spring contact element in position on the housing, and the third housing contact engagement portions of the third resilient contact arms and the first housing contact engagement portions of the first resilient contact arms engage the second end of the housing to retain the spring contact element in position on the housing.

* * * * *